US011084616B2

(12) United States Patent
Smith

(10) Patent No.: US 11,084,616 B2
(45) Date of Patent: Aug. 10, 2021

(54) SHRINK WRAP TUNNEL

(71) Applicant: ARPAC, LLC, Schiller Park, IL (US)

(72) Inventor: Steve Smith, Schiller Park, IL (US)

(73) Assignee: Arpac, LLC, Schiller Park, IL (US)

( * ) Notice: Subject to any disclaimer, the term of this patent is extended or adjusted under 35 U.S.C. 154(b) by 1092 days.

(21) Appl. No.: 14/530,646

(22) Filed: Oct. 31, 2014

(65) Prior Publication Data

US 2016/0122058 A1 May 5, 2016

(51) Int. Cl.

| | |
|---|---|
| ***B65B 53/06*** | (2006.01) |
| ***B65B 65/06*** | (2006.01) |
| ***F27B 9/24*** | (2006.01) |
| ***B65B 59/00*** | (2006.01) |
| *B65B 35/24* | (2006.01) |
| *B65B 59/02* | (2006.01) |

(52) U.S. Cl.

CPC ..... *B65B 53/063* (2013.01); *B65B 59/001* (2019.05); *B65B 59/003* (2019.05); *B65B 59/005* (2013.01); *B65B 65/06* (2013.01); *F27B 9/24* (2013.01); *B65B 35/24* (2013.01); *B65B 59/02* (2013.01)

(58) Field of Classification Search

CPC ..... B65B 11/50; B65B 61/06; B65B 61/12; B29C 63/42; B29C 63/38; B65D 71/00

USPC ..... 53/442, 499, 86, 446, 557; 156/85, 499, 156/86; 34/223, 506

See application file for complete search history.

(56) References Cited

U.S. PATENT DOCUMENTS

| | | | |
|---|---|---|---|
| 3,348,356 | A | 10/1967 | Curtis |
| 3,357,153 | A | 12/1967 | Shaffer |
| 3,526,752 | A | 9/1970 | Bell |

(Continued)

FOREIGN PATENT DOCUMENTS

| | | | |
|---|---|---|---|
| CN | 203094549 | U | 7/2013 |
| EP | 1288129 | A2 | 3/2003 |

(Continued)

OTHER PUBLICATIONS

European Extended Search Report issued by the European Patent Office in connection with EP15190753 dated Mar. 17, 2016.
European Search Report for EP 14159444.0 dated Jul. 22, 2014.

*Primary Examiner* — Chelsea E Stinson
*Assistant Examiner* — Mary C Hibbert-Copeland
(74) *Attorney, Agent, or Firm* — Levenfeld Pearlstein, LLC

(57) ABSTRACT

A heat shrink tunnel with width adjustment includes a pair of opposing side wall assemblies, each including an outer wall and an inner perforated wall defining a plenum therebetween. The opposing side walls define a product path with the side wall assemblies being movable toward and away from each other. A heater/blower assembly disposed in each of the opposing side walls and has an outlet directed into the product path. A shroud extends over the side wall assemblies and an open top space between the side all assemblies. The side wall assemblies extend upwardly toward an inside of the shroud so as to define a small gap between tops of the side wall assemblies and the inside of the shroud. The shroud has a bottom wall. A conveyor is configured to convey items through the heat shrink tunnel. A tunnel includes a side wall assembly width adjusting assembly to move the side walls toward and away from one another by actuation of a single actuator.

8 Claims, 12 Drawing Sheets

(56) References Cited

U.S. PATENT DOCUMENTS

| | | | | | |
|---|---|---|---|---|---|
| 3,531,873 | A * | 10/1970 | Beck | B65B 53/063 34/223 |
| 3,534,393 | A | 10/1970 | Bickham et al. | |
| 3,710,550 | A | 1/1973 | Osborne | |
| 3,711,957 | A * | 1/1973 | Carver, Jr. | B29C 35/04 219/388 |
| 4,063,401 | A | 12/1977 | Higgins | |
| 4,579,614 | A | 4/1986 | Burmeister et al. | |
| 5,471,818 | A | 12/1995 | Hannen | |
| 6,003,287 | A | 12/1999 | Ballestrazzi et al. | |
| 6,772,575 | B2 | 8/2004 | Limousin | |
| 7,155,876 | B2 | 1/2007 | VanderTuin et al. | |
| 7,363,728 | B1 | 4/2008 | McNeil et al. | |
| 2004/0123566 | A1 * | 7/2004 | Limousin | B65B 53/063 53/442 |
| 2004/0231301 | A1 | 11/2004 | VanderTuin et al. | |
| 2014/0272747 | A1 * | 9/2014 | Ciurkot | F27D 3/12 432/239 |

FOREIGN PATENT DOCUMENTS

| | | | | |
|---|---|---|---|---|
| EP | 2596780 | A1 | 5/2013 | |
| EP | 2778080 | A1 | 9/2014 | |
| FR | 1574464 | A | 7/1969 | |
| GB | 2150522 | A * | 7/1985 | B65B 9/22 |

* cited by examiner

SHRINK WRAP TUNNEL

BACKGROUND

Devices are known for wrapping or securing items for handling, transport and the like. Often, multiple items are placed together, bundled and a shrink wrap material is positioned around the items. The shrink wrap material is then heated to shrink around the bundled load. Such shrink wrap maintains the stability of the load and can provide protection against environmental conditions, such as water, dirt and the like.

Heating the shrink wrapped load is often carried out in a shrink wrap tunnel. Typically, a load to be shrink wrapped is presented to the tunnel on a conveyor. The load is wrapped with the material, which shrinks when subjected to heat. The load is conveyed through the tunnel and as it moves through the tunnel, heat, typically applied by forced air heaters, is blown over the wrapped load. The heat is sufficient to shrink the wrap onto the load to create a tightly wrapped package.

Known shrink wrap tunnels, include stationary walls. Because the heating elements are mounted to the walls, they too are stationary relative to the load moving through the tunnel, regardless of the size, or width of the load.

Loads, however, can consist of a wide variety of items, materials and the like, of a likewise wide variety of sizes. As such, there can be significant inefficiencies in heat shrink tunnels, especially when, for example, a narrow load is conveyed through a relatively wide tunnel. That is, the tunnel may be quite large, and the load much smaller. Thus, there are thermal losses and inefficiencies due to convective losses.

Accordingly, there is a need for a shrink wrap tunnel the reduces the inefficiencies inherent in the shrink wrapping process. Desirably, such a shrink wrap tunnel has a width that can be varied to accommodate loads having a variety of widths. More desirably, in such a shrink wrap tunnel, hot air can be directed or forced into open spaces around a wrapped load and drawn from the wrapped load, to minimize heat losses.

SUMMARY

A heat shrink tunnel with width adjustment includes a pair of opposing side wall assemblies, each including an outer wall and an inner perforated wall defining a plenum therebetween. The opposing side walls define a product path having a longitudinal axis. The side wall assemblies can be movable toward and away from the longitudinal axis and toward an away from one another.

A heater/blower assembly is disposed in each of the opposing side walls. Each heater blower assembly has an outlet directed into the product path and each draws air from the product path, through its respective plenum.

A shroud extends over the side wall assemblies and an open top space between the side wall assemblies. The side wall assemblies extend upwardly toward an inside of the shroud so as to define a small gap between tops of the side wall assemblies and the inside of the shroud.

A conveyor is configured to convey items through the heat shrink tunnel. A side wall assembly width adjusting assembly is configured to move the side wall assemblies toward and away from one another by actuation of a single actuator.

The shroud encloses the conveyor and the side wall assemblies to define the heat shrink tunnel. The side wall assembly width adjusting assembly is configured to move the side wall assemblies toward and away from the longitudinal axis and toward and away from one another by actuation of a single actuator or operator.

In an embodiment, the side wall assembly width adjusting assembly includes a pair of telescopic shafts extending between the side wall assemblies. The telescopic shafts have a thread on opposing ends thereof that cooperate with receivers mounted to the side wall assemblies. The threads are opposite-hand threads from one another and cooperate with receivers mounted to the side wall assemblies. In such an embodiment rotation of the threaded shaft moves the receivers and their respective side wall assemblies receivers in opposite directions toward and away from one another.

The drive shaft is operably connected to the telescopic shafts such that rotation of the drive shaft rotates both telescopic shafts. A drive is positioned at an end of the drive shaft. Bevel gears positioned at and end of each of the telescopic shafts and bevel gears positioned on the drive shaft cooperate with to rotate the telescopic shafts in conjunction with one another.

In a present embodiment the drive is a manually rotatable handle, however, it will be recognized that a wide variety of drives, manual and powered can be used. Controllers, to operate the entire or portions of the heat shrink tunnel can be used as well. Such controller can, for example, include temperature controllers for controlling a temperature of the air inside of the tunnel.

It will also be appreciated that the present configurations position the heaters/blower assemblies at the closest possible point to the load. This has a number of advantages, including short warm up times and short cycle times. Thus, the amount of time needed to commence the heat shrink operation can be significantly reduced, and the amount of energy used can be significantly reduced. In an embodiment, the blower is a cross-flow blower.

In an alternate embodiment, a heat shrink tunnel that incorporates the novel side wall assembly arrangement is anticipated that can be configured without moveable side walls (i.e., stationary side walls) and that such a configuration will provide many of the advantages presented above, including but not limited to short warm up and cycle times, reduced time to commence the heat shrink operation and reduced energy usage. In either embodiment, the tunnel can include a lower wall heater/blower assembly configured to discharge heater air upwardly, though the conveyor.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
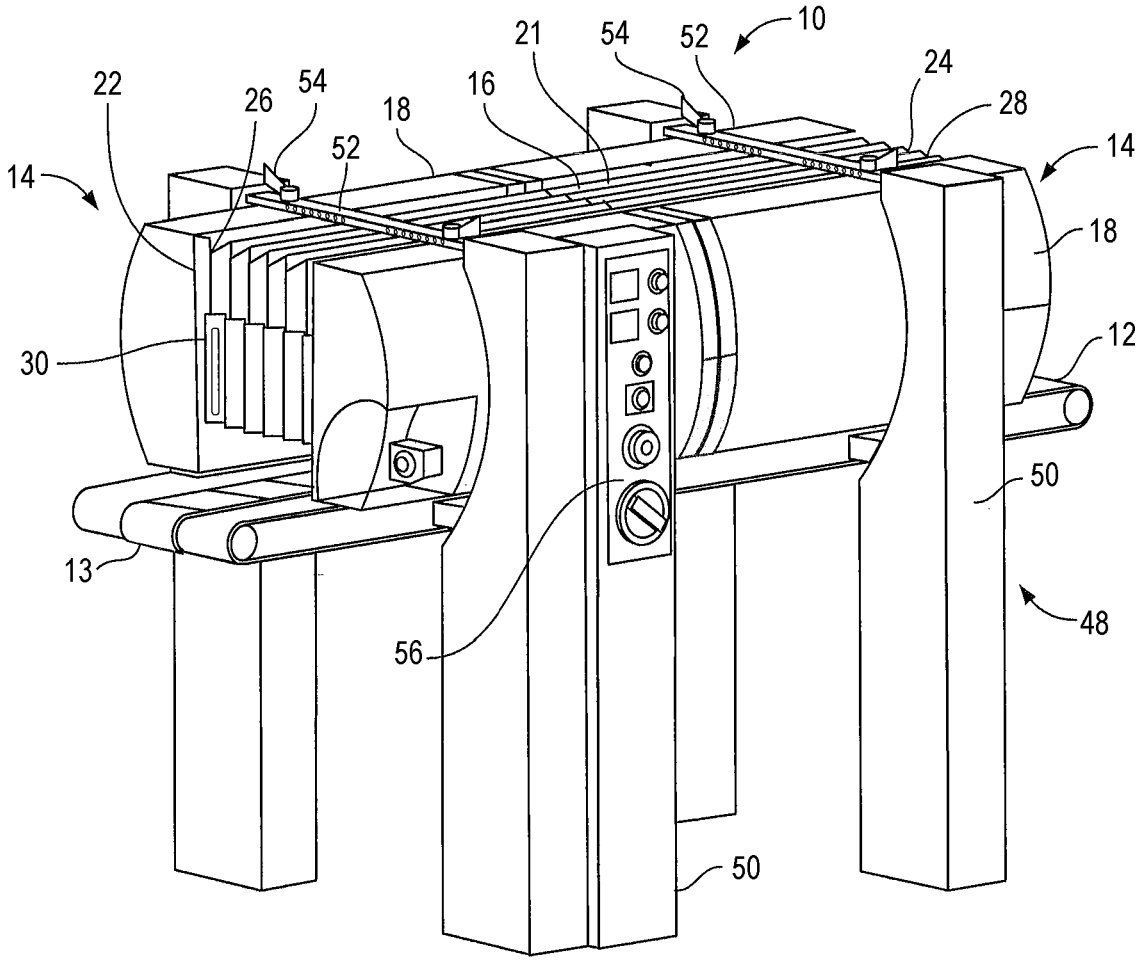
FIG. 1 is a perspective view of a shrink wrap tunnel with dynamic width adjustment.

Referring to the figures and in particular to FIG. 1 there is shown an embodiment of a shrink wrap tunnel 10 with dynamic width adjustment. The tunnel 10 is typically associated with a conveyor 12 to convey a load L through the tunnel 10. The conveyor 12 can define a bottom wall or floor for the tunnel 10. The conveyor can include a conveying element 13, such as a belt, chain, or other conveying medium for moving the load L or product through the tunnel 10. The conveyor 12 width can be adjustable to, for example, accommodate the product L width.

The tunnel 10 includes a pair of side wall assemblies 14 and a top or ceiling 16. The side wall assemblies 14 are moveable toward and away from each other (or a centerline $A_{12}$ of the conveyor 12) so as decrease or increase the distance $d_{14}$ between the walls 14. In a present embodiment, the side wall assemblies 14 include outer walls 18 that are curved, bowing outward at about the middle of the walls (as indicated at 20) and inward at the lower and upper junctions with the floor (or conveyor 12) and top 16, respectively.

In an embodiment, the top 16 is configured so that it expands and collapses to maintain a closed ceiling as the side wall assemblies 14 are moved outwardly and inwardly. In this embodiment, the top 16 is configured with an accordion panel 21 that expands and contracts to accommodate the movement of the side wall assemblies 14. Other wall expansion and contraction configurations can be provided to accommodate side wall assembly movement. For example, sliding panels can also be used.

In a present embodiment front and rear walls 22, 24 can be provided for the tunnel 10. The front and rear walls 22, 24 can also be configured to accommodate side wall assembly 14 movement by use of accordion walls/panels 26, 28 as shown, sliding panels and the like. In addition the front and rear walls 22, 24 can also include panels (front 30 shown, rear not shown) that allow for adjusting the height h of the tunnel opening O. As illustrated in FIG. 1, the panels (front 30 shown, rear not shown) can slide upward and downward to increase and decrease the height h of the tunnel opening O. It will be appreciated that the adjustment of the tunnel opening O height h will allow for minimizing heat losses from the tunnel 10.

The side wall assemblies 14 each include an inner wall 34 that, with their respective outer walls 18 each define an air plenum 36. The inner walls 34 are perforated or foraminous, as indicated at 38, to permit air flow between the tunnel 10 and the plena 36. In a present configuration, the inner, perforated walls 34 are formed from or coated with a low-stick or non-stick material, such as a metal coated with, for example, a Teflon® material coating to prevent shrink wrap material or debris from sticking to the walls 35, which could otherwise reduce airflow through the walls 34.

Figure 3:
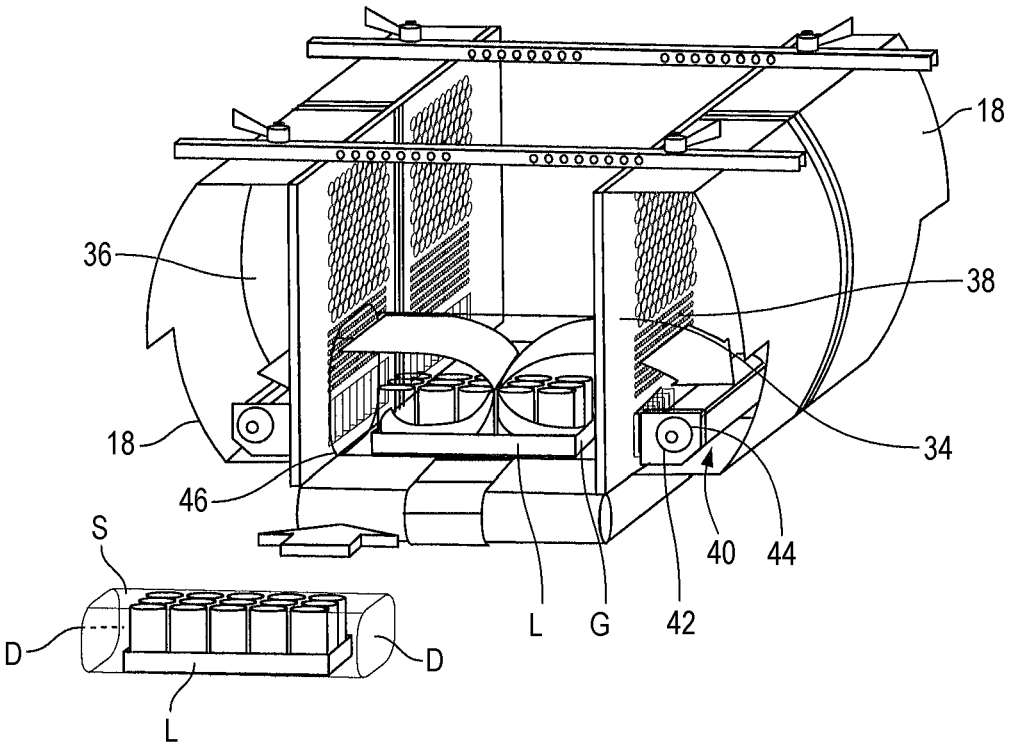
FIG. 3 is a perspective view of a portion of the shrink wrap tunnel shown broken away and showing a load positioned on the conveyor.
Figure 4:
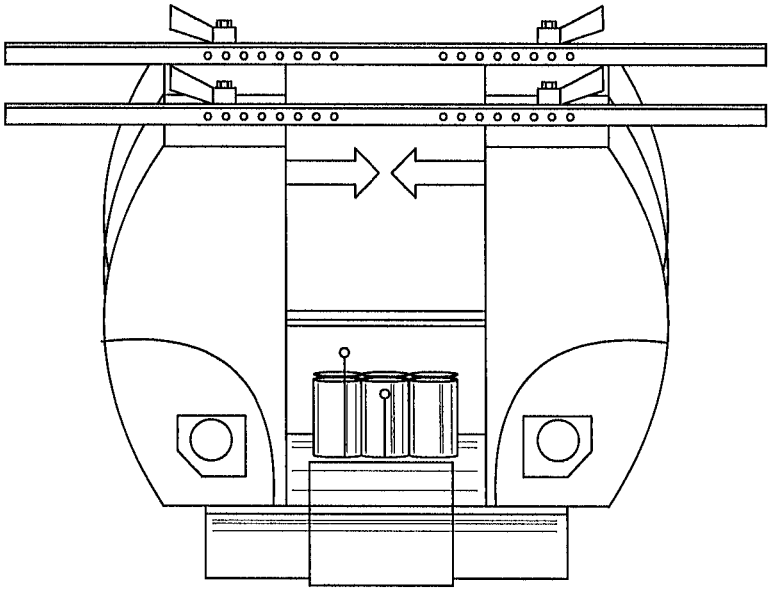
FIGS. 4 and 5 are front side illustrations of the tunnel showing the tunnel width being increased and decreased.
Figure 5:
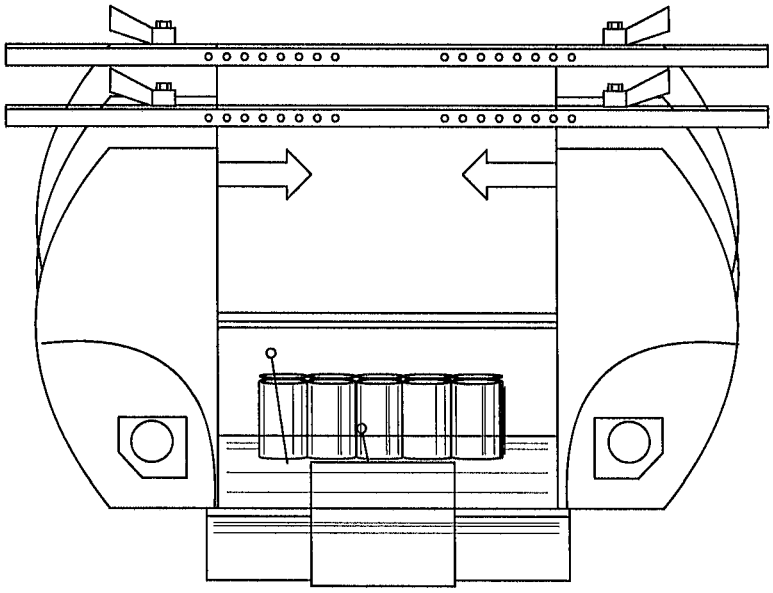
Figure 6:
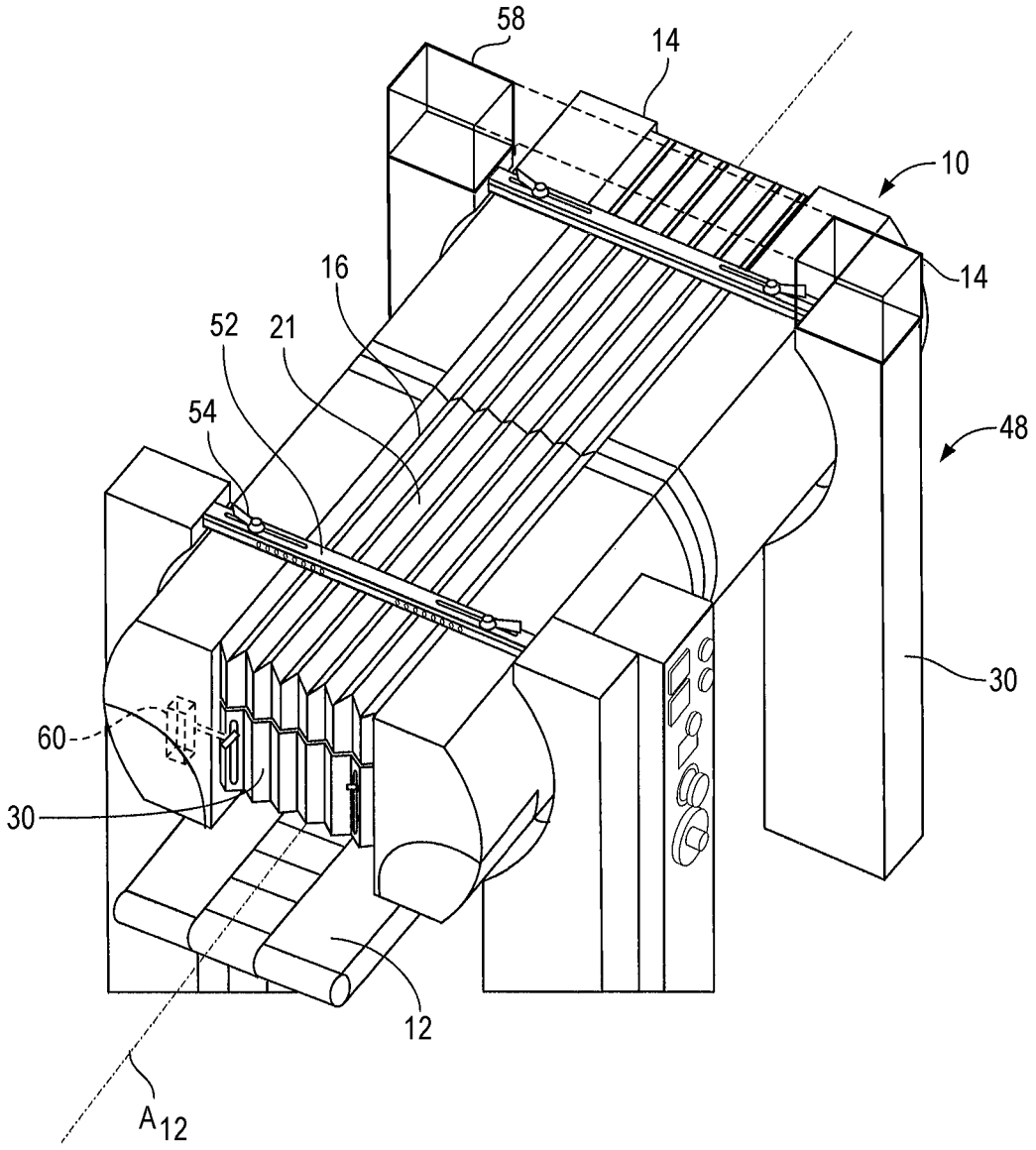
FIG. 6 is another perspective view of the shrink wrap tunnel.
Figure 7:
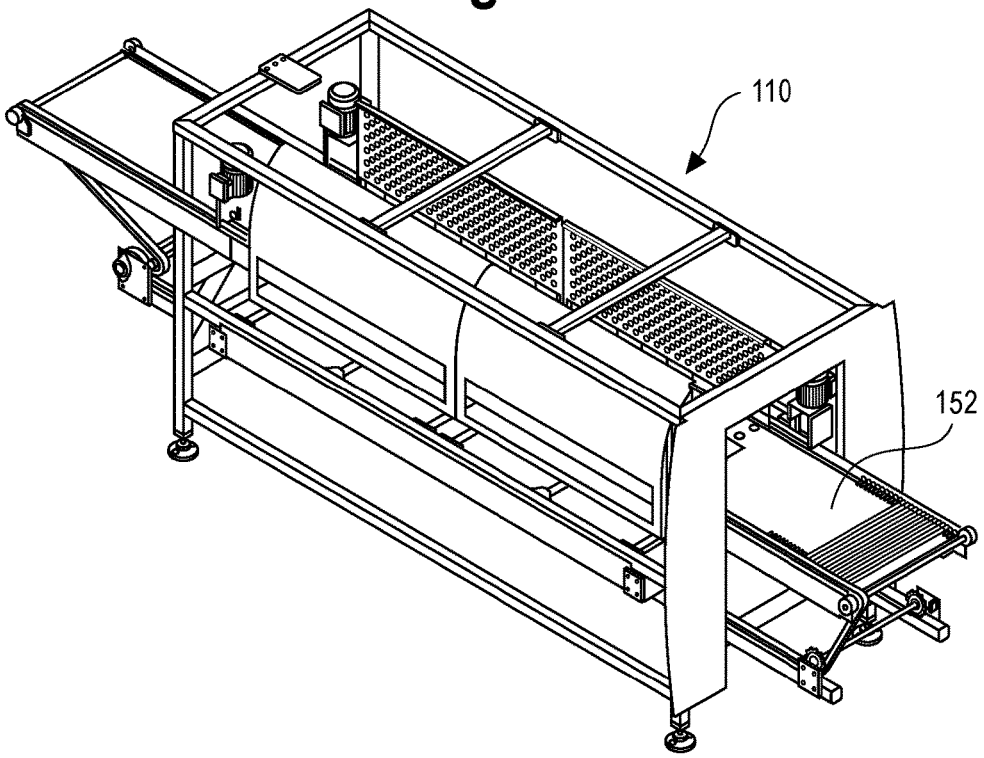
FIG. 7 is a perspective view of an alternate embodiment of the shrink wrap tunnel.
Figure 8:
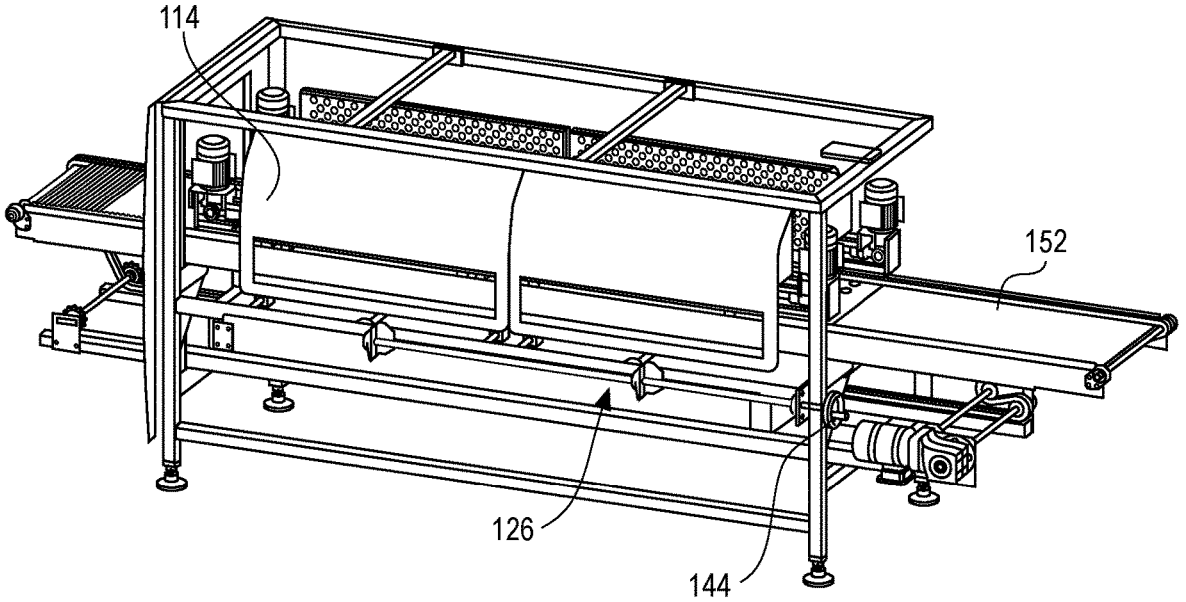
FIG. 8 is a side view of the tunnel of FIG. 7.

A heater/blower assembly 40 is positioned in each of the side wall assemblies 34, in each plenum 36. As seen in FIG. 3, the heater/blower assembly 40 is located between the inner 34 and outer 18 walls near the bottom of the plenum 36. The heater/blower assembly 40 includes a centrifugal blower or fan 42 and a heat source 44. Outlet vents 46 are positioned at the outlet of each of the assemblies 40. In a present embodiment the heat source 44 is an electric heater, such as a resistance wire heater. Other suitable heat sources will be recognized by those skilled in the art.

Figure 2:
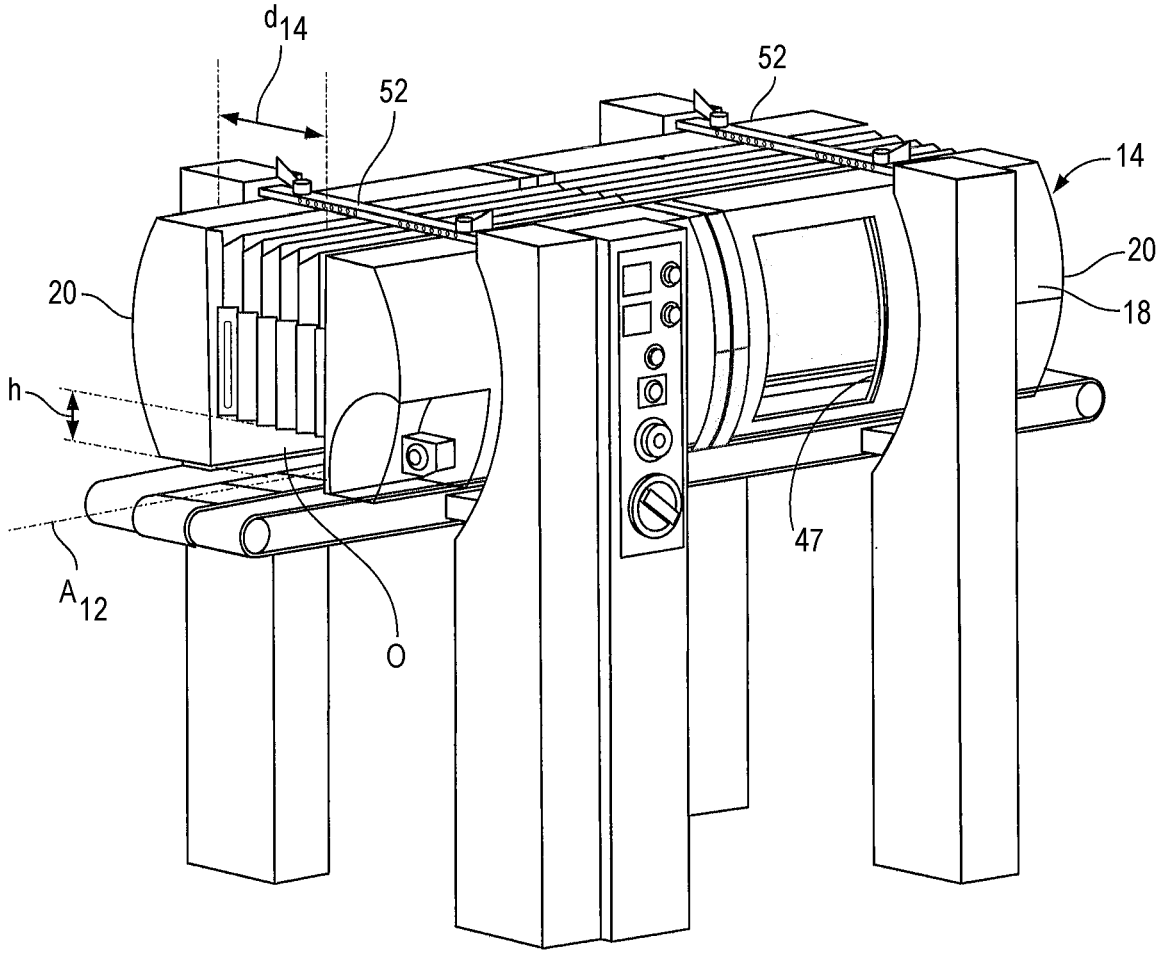
FIG. 2 is a view similar to FIG. 1, and showing a portion of the side wall out wall broken away.

As seen in FIG. 2, the tunnel 10 can include a layer of insulation 47 within the side wall assemblies 14. In a present embodiment the insulation 47 is present in the inside of the outer side wall 18 (on the plenum 36 side of the outer side wall 18) to further reduce heat losses from the tunnel 10 through the side wall assemblies 14.

The shrink tunnel 10 and conveyor 12 system can be mounted to a frame 48, such as that shown in FIG. 1. Support rails 52, mounted to the frame 48, can be configured to support the tunnel side wall assemblies 14 and or the top wall 16, to facilitate movement of the side wall assemblies toward and away from one another (decreasing and increasing the tunnel 10 width or distance $d_{14}$ between the side wall assemblies 14). The rails 52 can include locks 54 to lock the tunnel side wall assemblies 14 at a desired width $d_{14}$.

A controller 56 controls the overall operation of the tunnel 10. Operation can be manual or, optionally, various aspects of the tunnel 10 operation can be automatically controlled. For example, the internal temperature of the tunnel 10 can be monitored and controlled automatically, as can the speed at which the load L moves through the tunnel 10 (e.g., the conveyor 12 speed). It is also contemplated that further automatic operations can be incorporated into the present tunnel 10. For example, the width $d_{14}$ adjustment of the tunnel 10 as well as the height h adjustment of the front and rear walls 22, 24 may be carried out automatically. In such an arrangement, drives, such as servomotors or the like, such as indicated at 58 and 60, can drive the width $d_{14}$ adjustment and height h adjustment based upon the width and height of the load L as determined by sensors placed within the system 10.

In use, in an embodiment, the width (i.e., distance $d_{14}$ between the side wall assemblies 14) and height h (e.g., front and rear wall openings O) of the tunnel 10 are first set. It is anticipated that a load L will be positioned on the conveyor 12 for presentation to the tunnel 10. As seen in FIG. 3, the load L will have a sleeve S of shrink wrap material positioned around the load L with the open sides D of the sleeve S directed toward the side wall assemblies 14. As the load L moves along the conveyor 12, hot air is forced from the heater/blower assembly 40 through the outlet vents and is directed into the wrapped load L. Because the tunnel side wall assemblies 14 are adjusted to contact or nearly contact the inner perforated wall 34 and the edges of the sleeve S, the hot air is essentially all directed into the sleeve S, rather than into the space around or outside of the load L within the tunnel 10.

Moreover, because air is drawn into the plenum 36 through the perforated plates 34, there is a higher pressure region created within the sleeve S, which further facilitates drawing the air from sleeve S around the load L. Essentially, a high pressure region is created at the blower 40 discharge with a low pressure region created within the plenum 36. In addition, because the sleeve S edge is positioned to contact or nearly contact the perforated wall 34, the hot air blown into the sleeved load L (see, e.g., FIG. 3), is drawn out at the top and bottom of the sleeve, thus facilitating the flow of heated air and rapid heat exchange to the shrink wrap material.

An alternate embodiment of the heat shrink tunnel 110 is illustrated in FIGS. 7-18 and 20. In this embodiment, the tunnel 110 includes a shroud 112 that extends over the side wall assemblies 114 and top 116 of the tunnel 110. A lower housing 118 can complete the shroud to enclose the tunnel. In this embodiment, the top wall need not be movable or adjustable as the side wall assemblies move toward and away from the each other. Rather, the shroud 112 provides the enclosure over the upper space between the side wall assemblies 114. A gap 120 between the upper ends 122 of the side walls 114 and an inner surface 124 of the top of the shroud 112 is sufficiently small to reduce any significant heated air loss or egress through the spaces between the tops of the walls 114 and the shroud 112.

In the illustrated embodiment, the side walls 114 are movable toward and away from one another by a drive system 126 having a single operator or actuator. A pair of telescopic shafts 128 (an inboard shaft 128*a* and an outboard shaft 128*b*) extend between the side wall assemblies 114. Each shaft 128 has a threaded rod 130 having a bevel gear or miter gear 130 mounted to an end thereof. The shafts 128 are received in threaded receivers 134 mounted to opposing side wall assemblies 114. The threads on opposite ends of the shaft (for example, as seen at 136, 138) have opposing threads such that rotation of the shaft 128 in one direction oppositely drives the near and far (opposing) receivers 134. For example, if a near end 136 of the shaft 128 has a right-hand thread, the far end 138 of the shaft 128 has a left-hand thread. The receivers 134 are configured to receive the appropriate handed thread. In this manner, as the shaft 128 is rotated, the opposing receivers 134 move (in opposite directions) along the shaft 128 to move the receivers 134 toward and away from one another to adjust the side wall assemblies 114 inwardly and outwardly, respectively.

The inboard and outboard telescopic shafts 128*a* and 128*b* are linked to one another by a drive shaft 140. As such, as the drive shaft 140 is driven (rotated), it in turn rotates both telescopic shafts 128*a*, 128*b*. A bevel or miter gear 142 is mounted to the drive shaft 140, intermediate the outboard end and the drive, to mesh with the bevel gear 132*a* on the inboard shaft 128*a*. The drive for the drive shaft can be a manual handle 144 as illustrated, however, those skilled in the art will appreciate that a motor drive can be used to drive the drive system.

Figure 19:
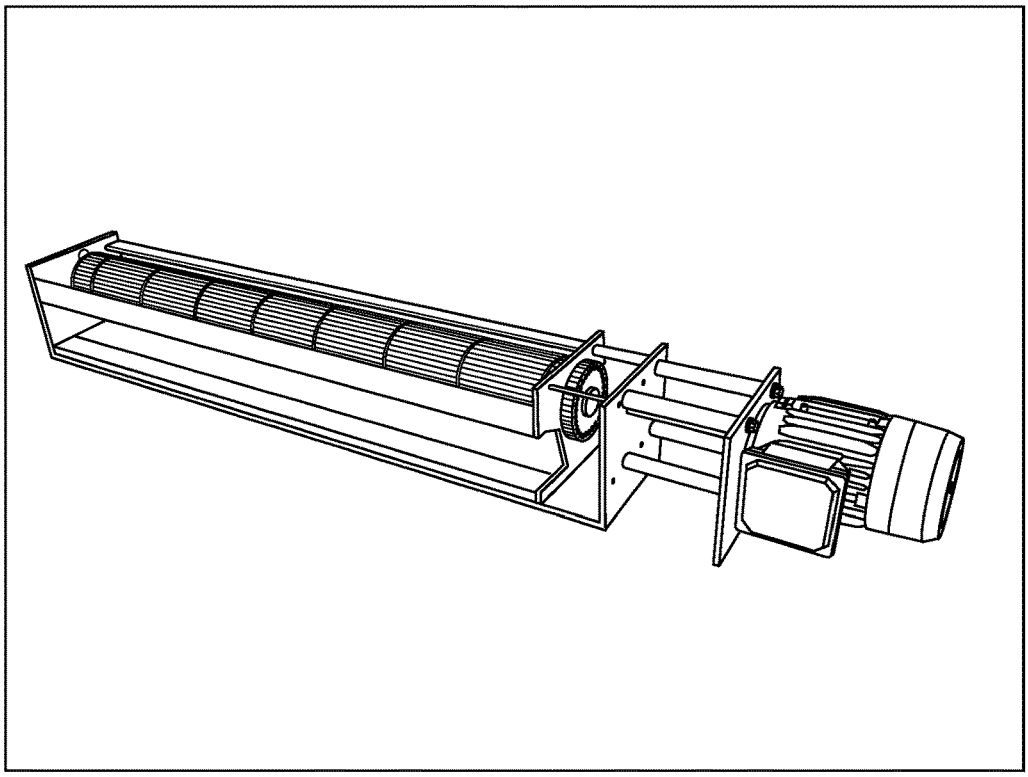
FIG. 19 is a photograph of a cross-flow blower used in the heater/blower assembly.
Figure 20:
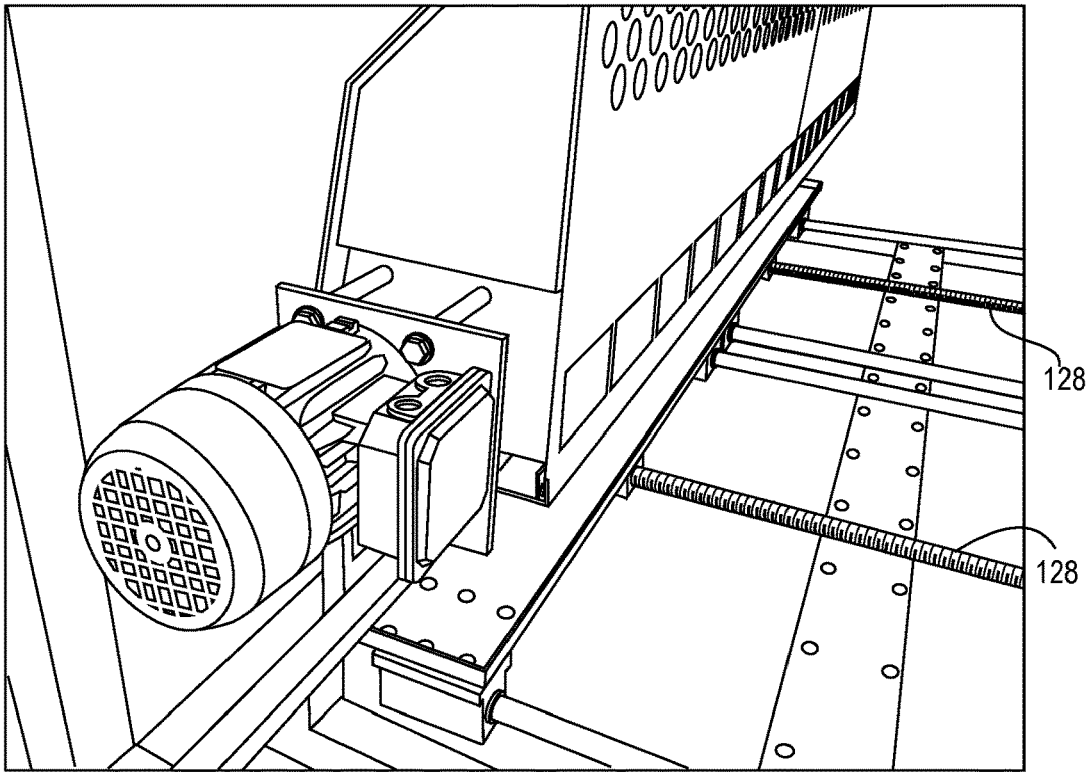
FIG. 20 is a photograph of the heater/blower assembly and shows the lower shroud in place and the telescopic shafts extending between the side wall assemblies

The shrink wrap tunnel 110 can also include a lower or bottom wall heater/blower assembly 146. Like the side wall assemblies 114, the lower wall heater/blower assembly includes a heater 148 and a blower 150, such as an electric heater, for example a resistance wire heater, and a blower assembly, such as a centrifugal blower or fan. In any of the embodiments of the tunnel, 10, 110, with or without the bottom wall heater/blower, a preferred blower is a cross-flow blower, such as that illustrated in FIG. 19. Such a blower, as will be appreciated by those skilled in the art, moves a relatively large volume of air, but generally at a lower efficiency. Nevertheless, in the present application in the heater blower assemblies 40, 148/150, a cross-flow blower provides a well distributed air flow along the length of the blower or along the length of the tunnel to better and more evenly distribute the heated air to the load.

Figure 9:
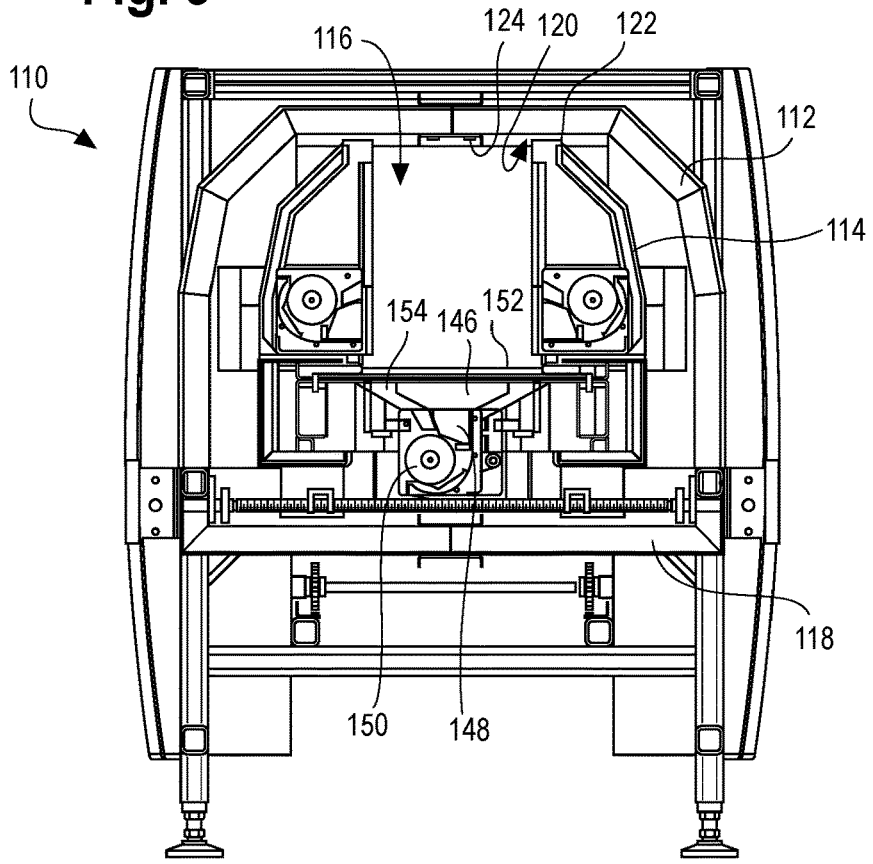
FIG. 9 is a front view of the tunnel with the tunnel shroud in place.
Figure 10:
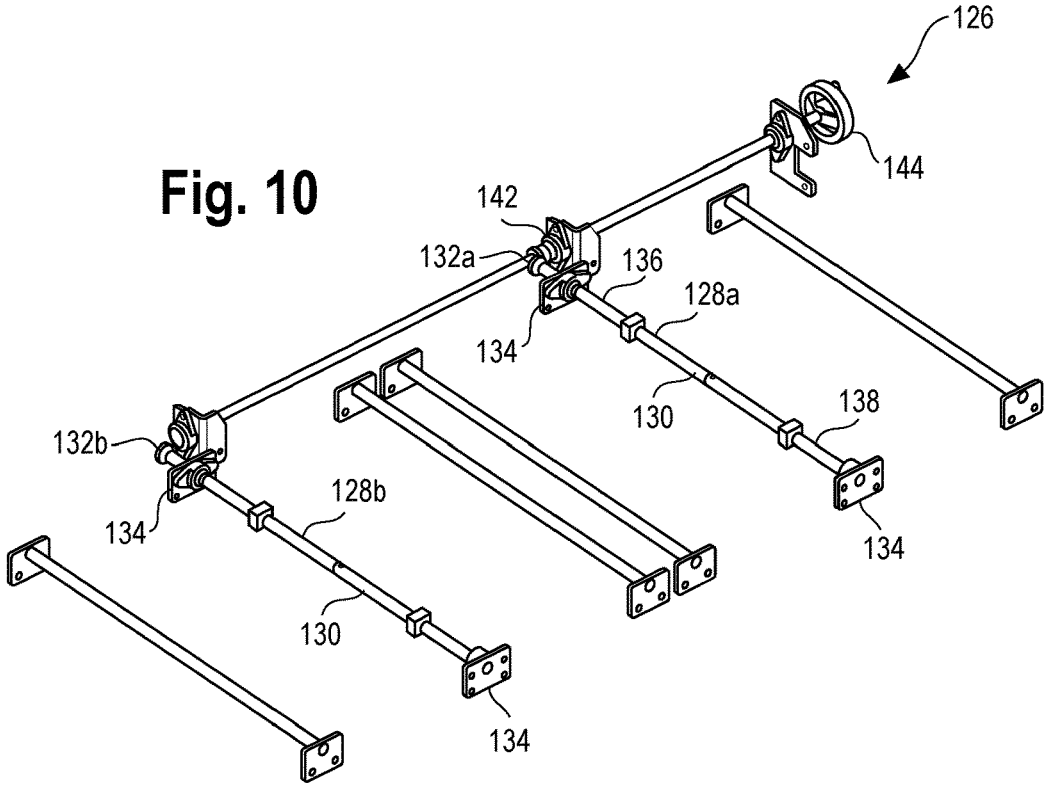
FIG. 10 is a partially exploded view of the telescopic width adjusting system.
Figure 11:
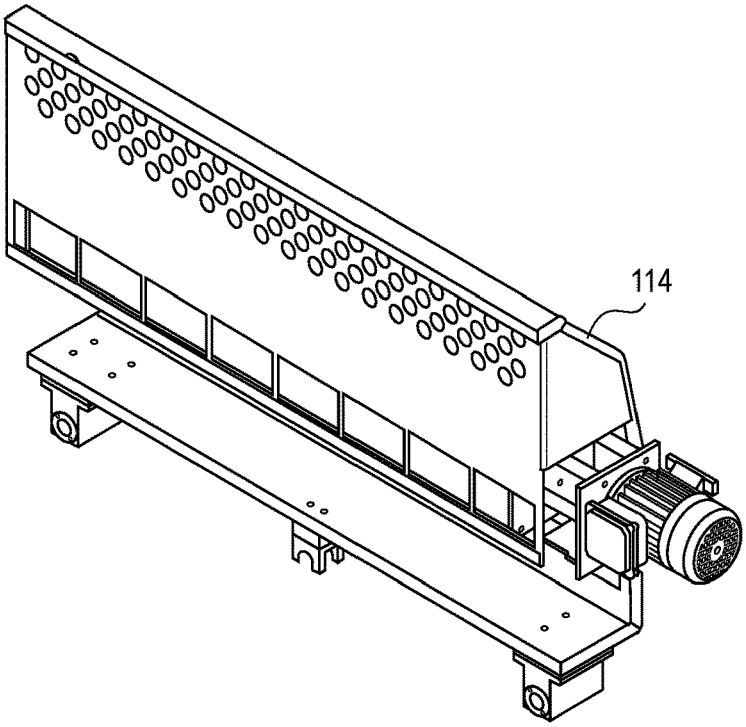
FIG. 11 is a perspective view of a heater/blower assembly.
Figure 12:
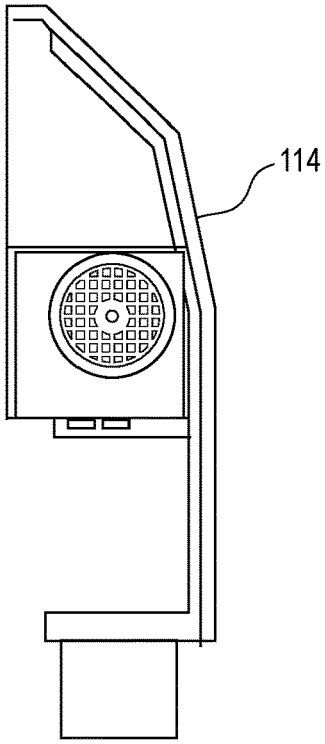
FIG. 12 is a side view of the heater/blower assembly.
Figure 13:
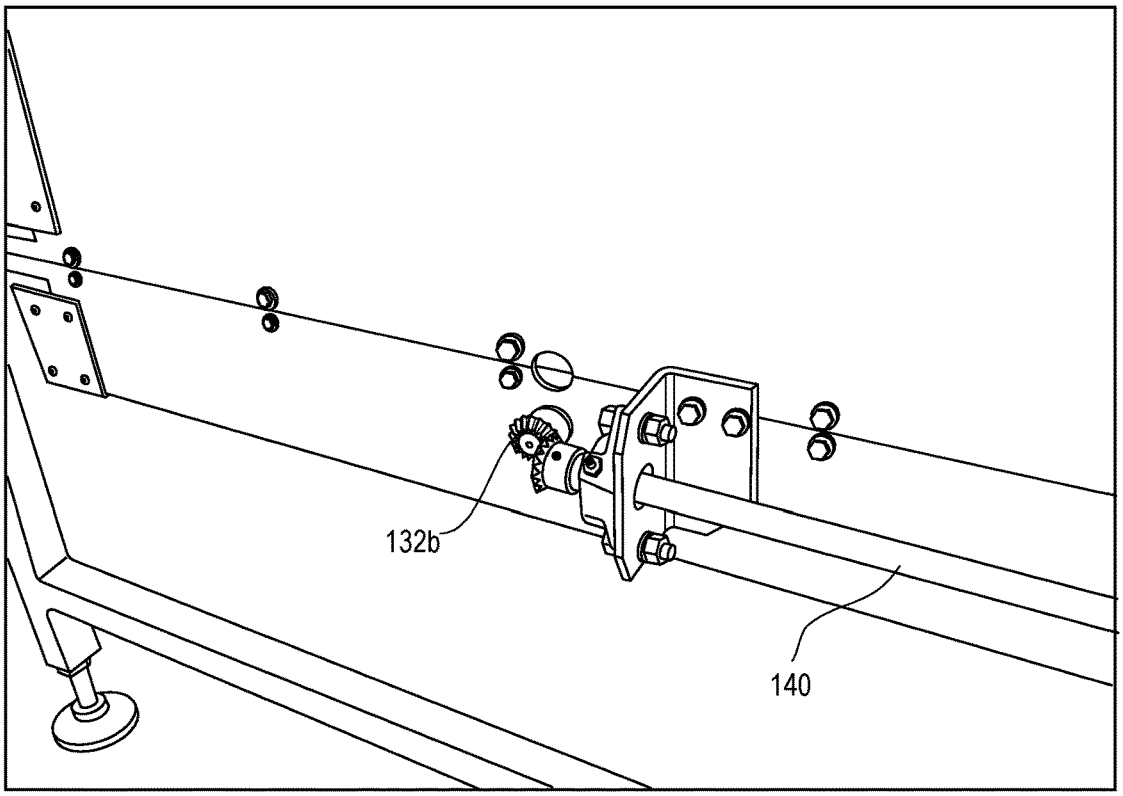
FIG. 13 is a photograph of a portion of the drive for the width adjusting system.
Figure 14:
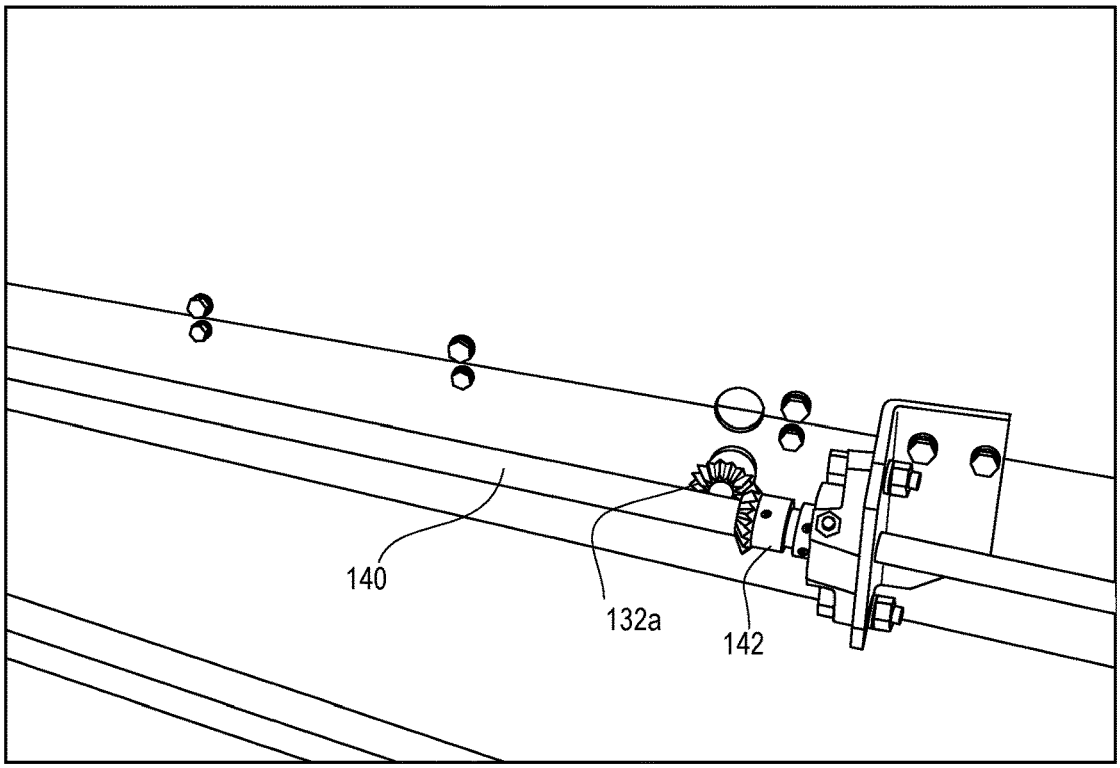
FIG. 14 is another photograph of a portion of the drive for the width adjusting system.
Figure 15:
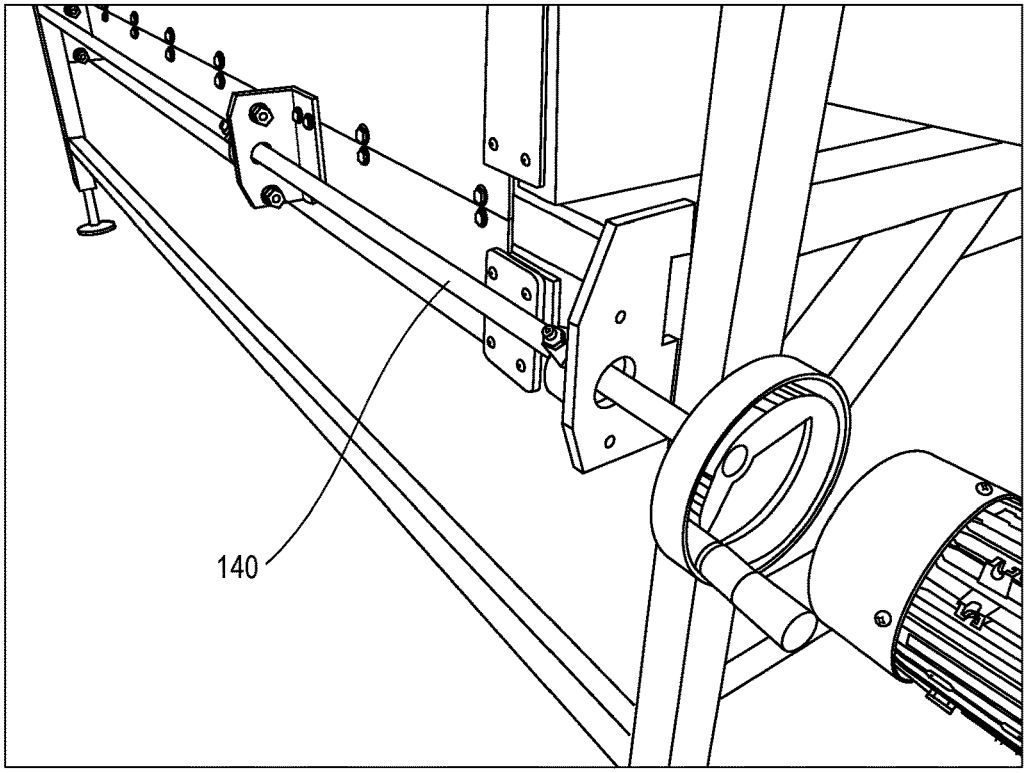
FIG. 15 is yet another photograph of a portion of the drive for the width adjusting system.
Figure 16:
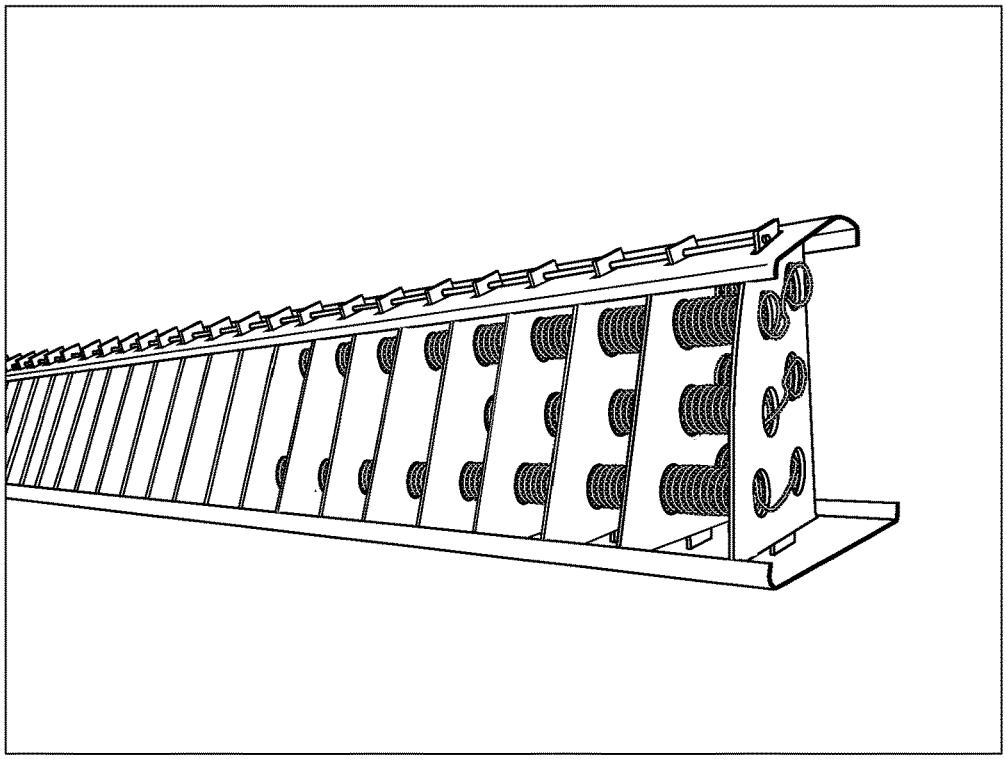
FIG. 16 is a photograph of a heater element for the heater/blower assembly.
Figure 17:
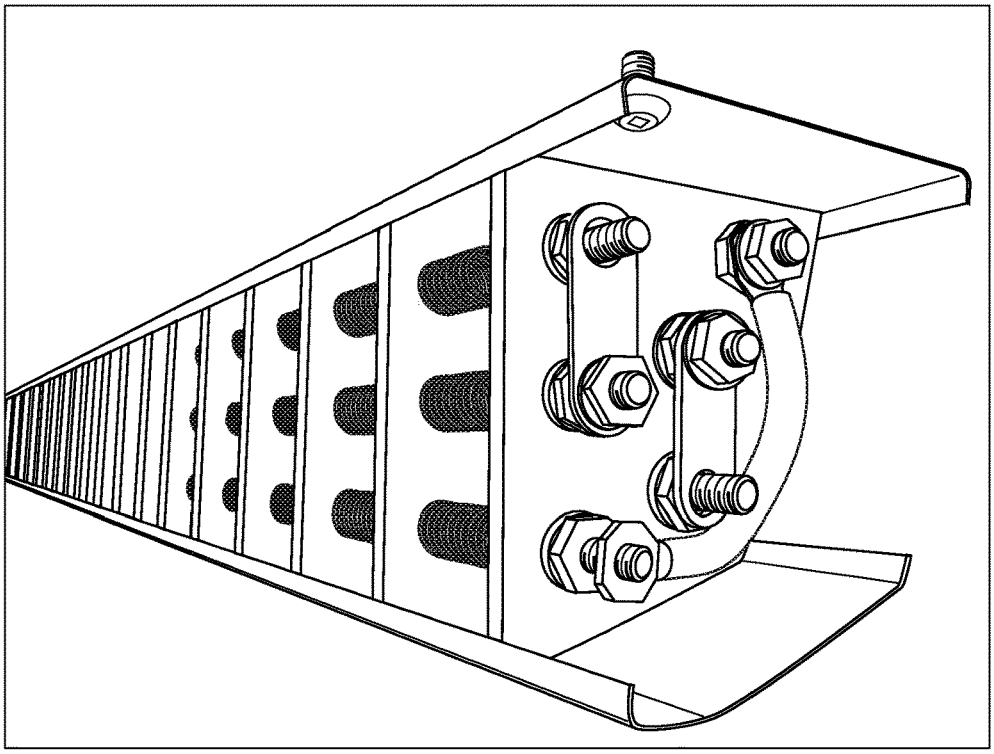
FIG. 17 is a another photograph of the heater element showing electrical jumpers for providing power to the heater coils.
Figure 18:
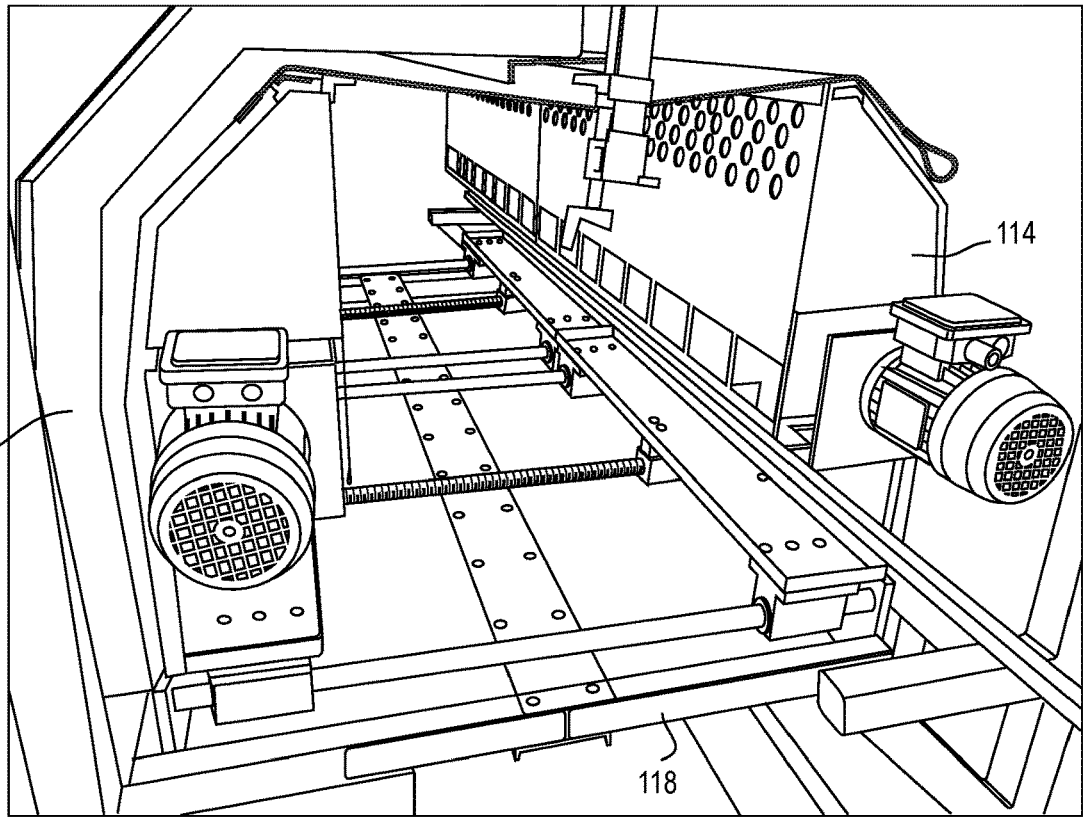
FIG. 18 is a photograph of the tunnel, partially erected and from a perspective position, showing the heater/blower assemblies in place on the machine frame and with a the lower shroud in place and a portion (a half) of the upper shroud in place.

Unlike the side wall assemblies, the lower heat/blower assembly 146 does not have an air inlet plenum to draw the recirculated heated air directly from the space between the walls. Rather the lower heater/blower assembly 146 directly draws air from within the tunnel 110 (within the shroud enclosed area) that is heated and directed (blown) up through the bottom of the conveyor 152. Instead, as seen in FIG. 9, the lower heater/blower 146 includes an outlet plenum 154 to direct the heated air upwardly and outwardly (to spread) the heated air along the width of the conveyor 152.

Also unlike the side wall assemblies 114, the lower heater/blower assembly 146 is stationary. That is, it does not move with the adjustment of the side wall assemblies 114. In that the lower heater/blower assembly 146 is immediately below the conveyor 152, it is in close proximity to the load in the tunnel 110.

Although not illustrated in the figures, the side wall assemblies can include stacked heater/blower assemblies. In such an embodiment, the heater/blower assemblies can be stacked, one on top of the other to provide heated air distribution over a greater height of load. Referring to FIG. 9, it is anticipated that in such an arrangement, the height of the side walls can be increased to accommodate the increased height required for the additional heater/blower assemblies.

It will also be appreciated that the present configurations position the heaters/blower assemblies 40, 114 at the closest possible point to the load. This has a number of advantages, including short warm up times and short cycle times. Thus, the amount of time needed to commence the heat shrink operation can be significantly reduced, and the amount of energy used can be significantly reduced. Accordingly a heat shrink tunnel that incorporates the novel side wall assembly arrangement is anticipated that can be configured without the moveable side wall assemblies (i.e., stationary side wall assemblies) and that such a configuration will provide many of the advantages presented above, such as short warm up and cycle times, reduced time to commence the heat shrink operation and reduced energy usage.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A heat shrink tunnel with width adjustment, comprising:

a pair of opposing side wall assemblies, each assembly including an outer wall and an inner perforated wall defining a plenum therebetween, the opposing side walls defining a product path therebetween, the product path defining a longitudinal axis, the side wall assemblies being movable toward and away from the longitudinal axis;

a heater/blower assembly disposed in each of the opposing side walls, each heater blower assembly having an outlet directed into the product path, each heater/blower assembly drawing air from the product path, through its respective plenum;

a shroud extending over the side wall assemblies and an open top space between the side wall assemblies, the side wall assemblies extending upwardly toward an inside of the shroud so as to define a small gap between tops of the side wall assemblies and the inside of the shroud, the shroud having a bottom wall;

a conveyor, the conveyor configured to convey items through the heat shrink tunnel;

a bottom wall heater/blower assembly positioned below the conveyor configured to discharge heated air upwardly, through the conveyor, the bottom wall blower being a centrifugal blower; and a side wall assembly width adjusting assembly configured to move the side wall assemblies toward and away from one another by actuation of a single actuator, wherein the shroud encloses the conveyor and the side wall assemblies to define the heat shrink tunnel, and wherein the side wall assembly width adjusting assembly is configured to move the side wall assemblies toward and away from the longitudinal axis and toward and away from one another, and wherein the side wall heater/blower assemblies each include a cross-flow blower.

2. The heat shrink tunnel of claim 1 wherein the side wall assembly width adjusting assembly includes a pair of telescopic shafts extending between the side wall assemblies.

3. The heat shrink tunnel of claim 2 wherein each shaft telescopic shaft has a thread on opposing ends thereof, the threads being opposite-hand threads from one another, and wherein the threads cooperate with receivers mounted to the side wall assemblies, such that rotation of the threaded shaft moves the receivers and their respective side wall assemblies receivers in opposite directions, toward and away from one another.

4. The heat shrink tunnel of claim 3 including a drive shaft operably connected to the telescopic shafts wherein rotation of the drive shaft rotates both telescopic shafts.

5. The heat shrink tunnel of claim 4 including a drive positioned at an end of the drive shaft, bevel gears positioned at and end of each of the telescopic shafts and bevel gears positioned on the drive shaft to cooperate with and the bevel gears on each of the telescopic shaft.

6. The heat shrink tunnel of claim 5, wherein the drive is a manually rotatable handle.

7. The heat shrink tunnel of claim 1 including a controller.

8. The heat shrink tunnel of claim 7 including one or more temperature controllers for controlling a temperature of the air inside of the tunnel.

* * * * *